US008893609B2

(12) United States Patent
Taki et al.

(10) Patent No.: US 8,893,609 B2
(45) Date of Patent: Nov. 25, 2014

(54) ENGINE COMPONENT INCLUDING BREATHER APPARATUS, AND ENGINE BODY INCORPORATING SAME

(75) Inventors: Masafumi Taki, Saitama (JP); Hideyuki Tawara, Saitama (JP); Masaji Narushima, Saitama (JP); Toru Nishi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 930 days.

(21) Appl. No.: 13/045,022

(22) Filed: Mar. 10, 2011

(65) Prior Publication Data

US 2011/0232477 A1 Sep. 29, 2011

(30) Foreign Application Priority Data

Mar. 23, 2010 (JP) ..... 2010-066424

(51) Int. Cl.
*F15B 21/04* (2006.01)
*F01B 1/00* (2006.01)
*F01M 13/00* (2006.01)

(52) U.S. Cl.
CPC ..... *F01M 13/0011* (2013.01)
USPC ..... 92/82; 92/147

(58) Field of Classification Search
USPC ..... 92/82, 146, 147, 171.1; 123/41.86
See application file for complete search history.

(56) References Cited

U.S. PATENT DOCUMENTS 8,181,635 B2 * 5/2012 Ogawa et al. ..... 123/41.86

FOREIGN PATENT DOCUMENTS

JP 4175816 B2 11/2008

* cited by examiner

*Primary Examiner* — Michael Leslie
(74) *Attorney, Agent, or Firm* — Carrier Blackman & Associates, P.C.; Joseph P. Carrier; Jeffrey T. Gedeon

(57) ABSTRACT

An engine body includes a crankcase with a crank chamber therein, a cylinder block attached to the crankcase, and a breather passage which selectively permits fluid communication between the crank chamber and an area outside of the crank chamber. The engine body includes a one-way valve between the crank chamber and the breather passage, which allows a one-way flow of gases from the crank chamber to the breather passage. The one-way valve is pressure-operated and is operatively attached to a side wall of the engine body proximate a cylinder sleeve. The one-way valve may be mounted in a mounting window in a side wall of the crankcase, and a timing chamber may function as the breather passage. In an illustrative embodiment, the one-way valve includes a base plate having a valve hole formed therein, and a flexible reed valve plate with one end affixed to the base plate.

19 Claims, 8 Drawing Sheets

ENGINE COMPONENT INCLUDING BREATHER APPARATUS, AND ENGINE BODY INCORPORATING SAME

CROSS-REFERENCE TO RELATED APPLICATIONS

The present invention claims priority under 35 USC 119 based on Japanese patent application No. 2010-066424, filed on Mar. 23, 2010. The subject matter of this priority document is incorporated by reference herein.

BACKGROUND OF THE INVENTION

1. Field of the Invention

The present invention relates to an engine component for an engine body, including an improved breather apparatus and in which a breather passage is formed, and also relates to an engine body incorporating the described engine component. The breather apparatus is provided for selectively allowing communication between a crank chamber and an area outside of the crank chamber. More particularly, the present invention relates to a engine component including a breather apparatus comprising a one-way valve, which allows a one-way flow of a gas from an interior side thereof to a breather passage, and which is disposed between the crank chamber and the breather passage. The invention also relates to an engine body including the described engine component.

2. Description of the Background Art

With respect to breather devices for engines, as disclosed in Japanese Patent No. 4175816, for example, a breather apparatus for an engine has been already known in which a one-way valve is formed as a rotary valve by making use of a balancer shaft, which is rotated in conjunction with a crankshaft.

In the known breather apparatus for an engine disclosed in Japanese Patent 4175816, mounting of the rotary-type one-way valve requires a relatively large space, and it is necessary to provide a stationary valve sleeve, which is operated cooperatively with the rotary valve. As a result, miniaturization of the engine is impeded, and it is also difficult to reduce associated costs, because of the relatively complicated structure.

SUMMARY OF THE INVENTION

The present invention has been made under such circumstances, and it is an object of the present invention to provide an engine component including a breather apparatus which enables mounting of a one-way valve without impeding miniaturization of the engine, and which can be manufactured at a low cost because of a simple structure.

To achieve the above-mentioned object, in the inventive engine component, a breather apparatus is disposed proximate a breather passage which opens a crank chamber to an area outside of the crank chamber, and a one-way valve which allows a one-way flow of a gas from the crank chamber to a breather passage side is interposed between the crank chamber and the breather passage. A first technical feature of the present invention is that in an installed configuration of the engine component in an engine body, the one-way valve is formed as a pressure-responsive valve, and the one-way valve is operatively attached to a side wall of the engine body proximate a cylinder sleeve.

The present invention also has, in addition to the first technical feature, a second technical feature that a timing chamber which houses a timing power transmission device for operating a valve therein is formed adjacent to the cylinder sleeve in an extending manner between a crankcase and a cylinder block which each form part of the engine body, and to allow the timing chamber to function also as a part of the breather passage, the one-way valve is mounted on a side wall of the crankcase which is interposed between the timing chamber and the crank chamber.

The present invention also has, in addition to the second technical feature, a third technical feature that a lower end portion of the cylinder sleeve is made to project toward a crankcase side from the cylinder block, a vent groove which is communicated with the crank chamber is formed between an outer peripheral surface of the lower end portion of the cylinder sleeve and an inner peripheral surface of the crankcase which faces the outer peripheral surface in an opposed manner, and the one-way valve which allows the one-way flow of a gas from a vent groove side to the breather passage side is mounted on the side wall of the crankcase which is interposed between the vent groove and the breather passage.

The present invention also has, in addition to the second or third technical feature, a fourth technical feature that the one-way valve is formed of a reed valve which includes a base plate having a valve hole and a reed valve plate which has one end thereof fixedly mounted on the base plate, has elasticity in a closing direction of the valve hole, and has a wall thickness smaller than a wall thickness of the side wall, and the whole one-way valve is housed in the side wall.

The present invention also has, in addition to the fourth technical feature, a fifth technical feature that a mounting window which allows mounting of the one-way valve from an upper-end-surface side of the side wall is formed on the side wall, and a mounting position of the one-way valve on the mounting window is held by the cylinder block joined to an upper end surface of the side wall.

Advantages of the Inventive Embodiments

According to the first technical feature of the present invention, the pressure-responsive one-way valve which is relatively small in size and has a simple structure can be easily mounted by making use of the side wall of the engine body which has a relatively large dead volume proximate the cylinder sleeve and hence, the first technical feature can contribute to simplification and the miniaturization of the structure of the breather apparatus leading to the miniaturization of the engine and also the reduction of cost.

According to the second technical feature of the present invention, the timing chamber functions also as a part of the breather passage and hence, it is completely unnecessary to form a dedicated breather passage in the inside of the engine body so that the second technical feature can contribute to the simplification of the structure of the breather apparatus.

According to the third technical feature of the present invention, the vent groove which is communicated with the crank chamber is formed between the outer peripheral surface of the lower end portion of the cylinder sleeve and the inner peripheral surface of the crankcase which faces the outer peripheral surface in an opposed manner, and the one-way valve is mounted on the side wall of the crankcase which is interposed between the vent groove and the timing chamber. Accordingly, it is difficult for splashing oil from the crank chamber to intrude into the relatively narrow vent groove, so that it is possible to minimize or eliminate transfer of splashing oil through the one-way valve.

According to the fourth technical feature of the present invention, the one-way valve is formed as a reed valve which is pressure-responsive, the wall thickness of the one-way valve is set smaller than the wall thickness of the side wall, and the one-way valve is housed in the side wall. Accordingly, the one-way valve can be easily mounted on the side wall of the crankcase having a relatively small wall thickness and hence, the fourth technical feature largely contributes to the miniaturization of the engine.

According to the fifth technical feature of the present invention, a special holding means for holding the mounting position of the one-way valve on the mounting window of the side wall is unnecessary so that the fifth technical feature contributes to the simplification of the mounting structure of the one-way valve.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Descriptions will be provided below of selected illustrative embodiments of the present invention on a basis of examples of the present invention, supported by and shown in the accompanying drawings. It should be understood that only structures considered necessary for clarifying the present invention are described herein. Other conventional structures, and those of ancillary and auxiliary components of the system, will be known and understood by those skilled in the art. In the present description, the directions of "front and rear", "up and down" and "left and right" correspond to the directions of "front and rear", "up and down" and "left and right" of the motorcycle which has the engine E mounted thereon, as viewed from a vantage point of an operator of the motorcycle.

Figure 1:
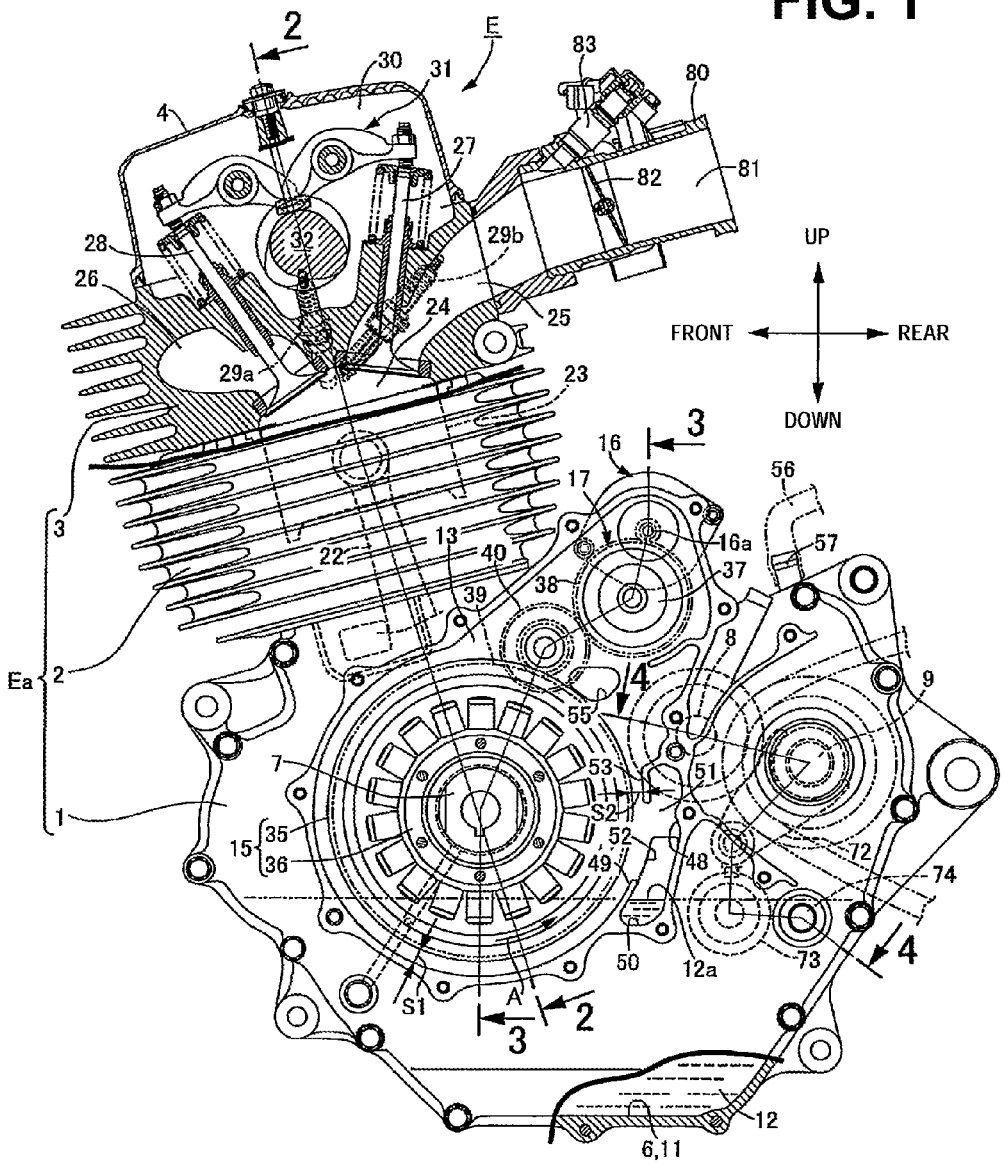
FIG. 1 is a side plan view, with a part broken away, of an engine for use on a motorcycle.
Figure 2:
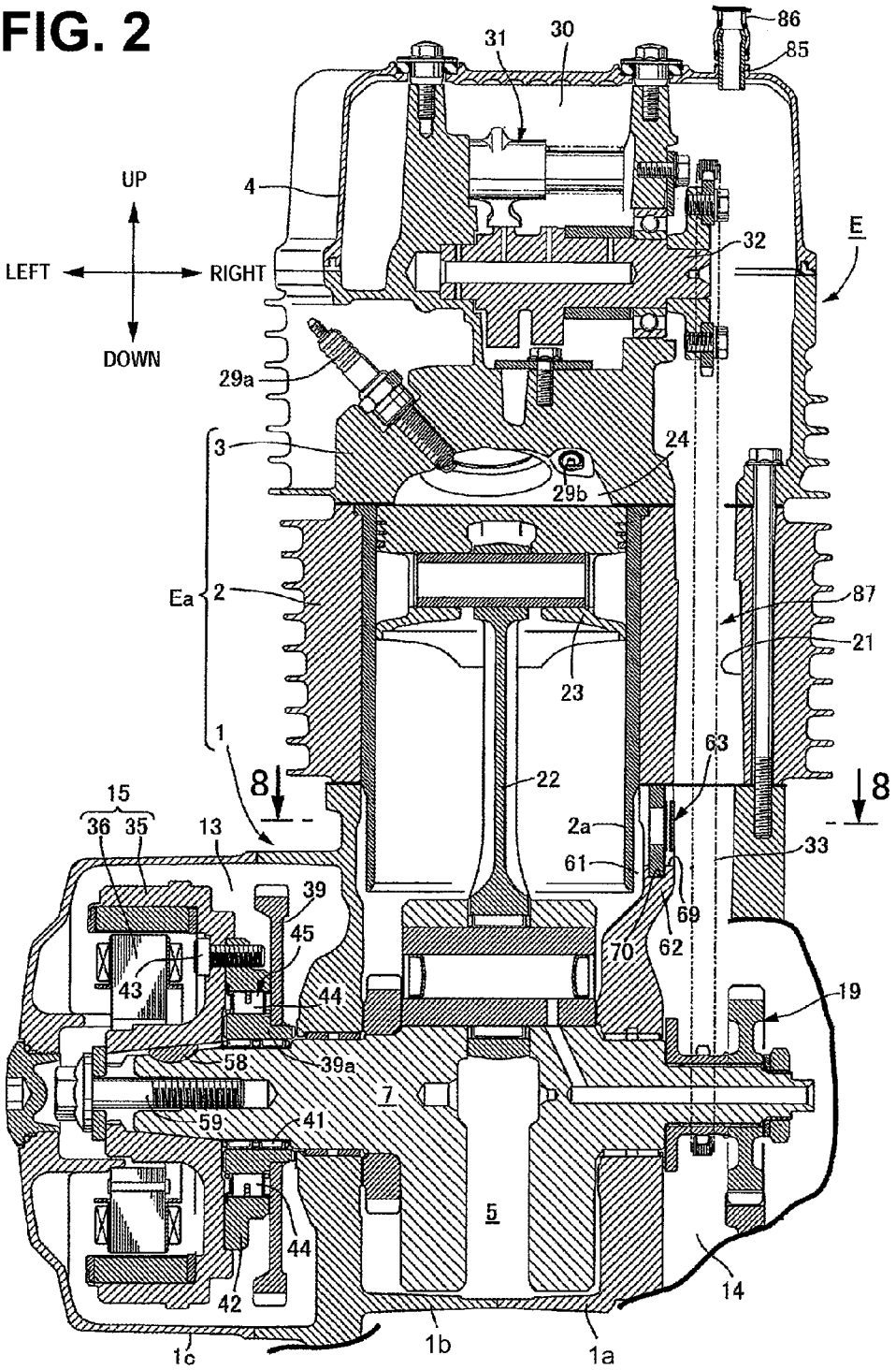
FIG. 2 is a cross-sectional view of the engine of FIG. 1, taken along the line 2-2 therein.

An engine body Ea of an engine E, shown in FIGS. 1-2, is configured and arranged to be mounted on a motorcycle (not shown). The engine body Ea includes a crankcase 1, a cylinder block 2 which is bolted to an upper surface of the crankcase 1, and a cylinder head 3 which is bolted to an upper surface of the cylinder block 2. A head cover 4 is bolted to an upper end surface of the cylinder head 3.

Further, the crankcase 1 includes a left case body 1*b* and a right case body 1*a* (FIG. 2, 8) which are bolted together, a left case cover 1*c* which is bolted to an outer end surface of the left case body 1*b*, and a right case cover 1*d* (see FIG. 4) which is bolted to an outer end surface of the right case body. A crank chamber 5 and a transmission chamber 6 are defined between the right and left case bodies 1*a*, 1*b*, with the transmission chamber 6 arranged behind and adjacent to the crank chamber 5 with a partition wall situated therebetween. A crankshaft 7 is housed in the crank chamber 5, and the crankshaft has respective end portions thereof supported on the right and left case bodies 1*a*, 1*b*.

Figure 4:
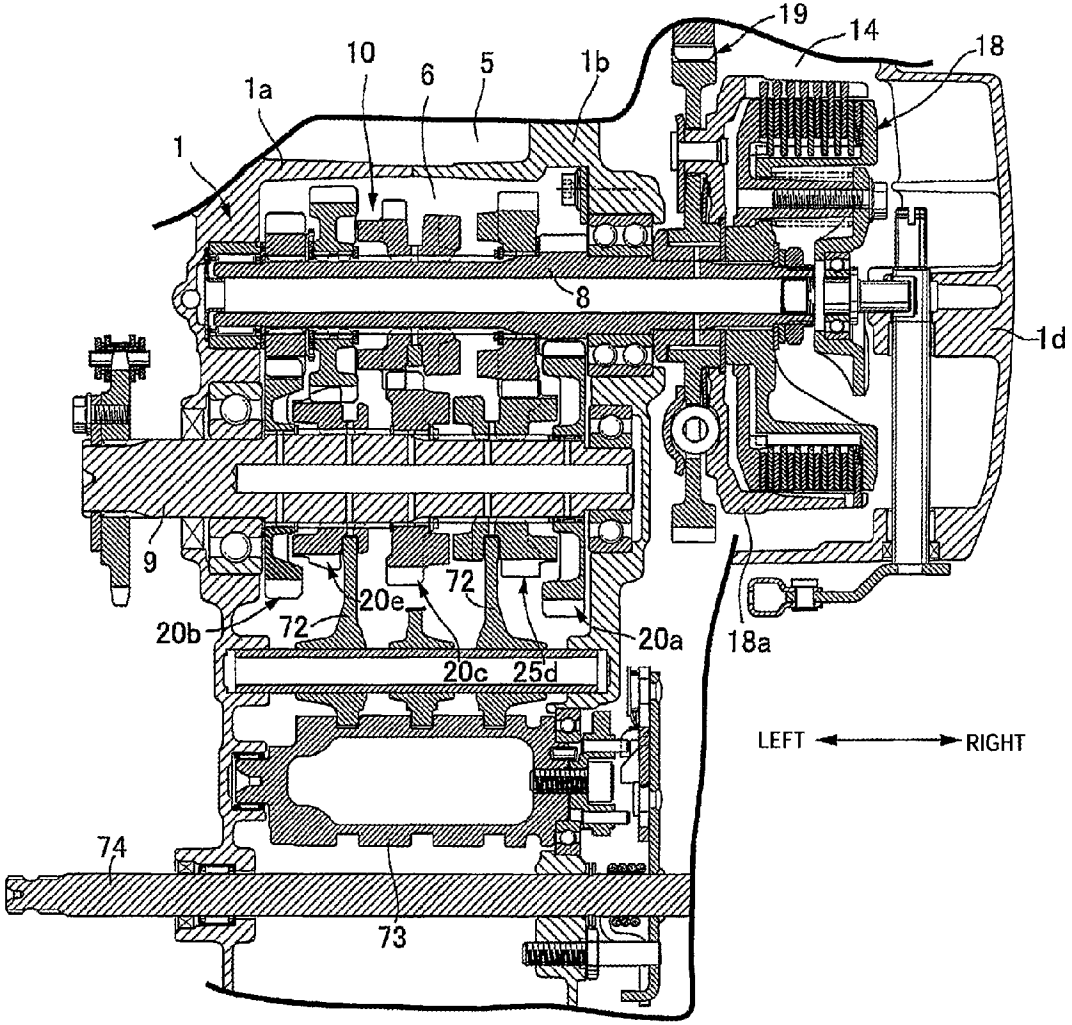
FIG. 4 is a cross-sectional view of the engine of FIG. 1, taken along a line 4-4 therein.

As seen in FIGS. 1 and 4, a transmission 10, provided with an input shaft 8 and an output shaft 9 each having respective end portions thereof supported on the right and left case bodies 1*a*, 1*b* is housed in the transmission chamber 6. A bottom portion of the transmission chamber 6 is formed deeper than the crank chamber 5 thus forming an oil reservoir or sump 11 for storing a predetermined quantity of lubrication oil 12.

Figure 3:
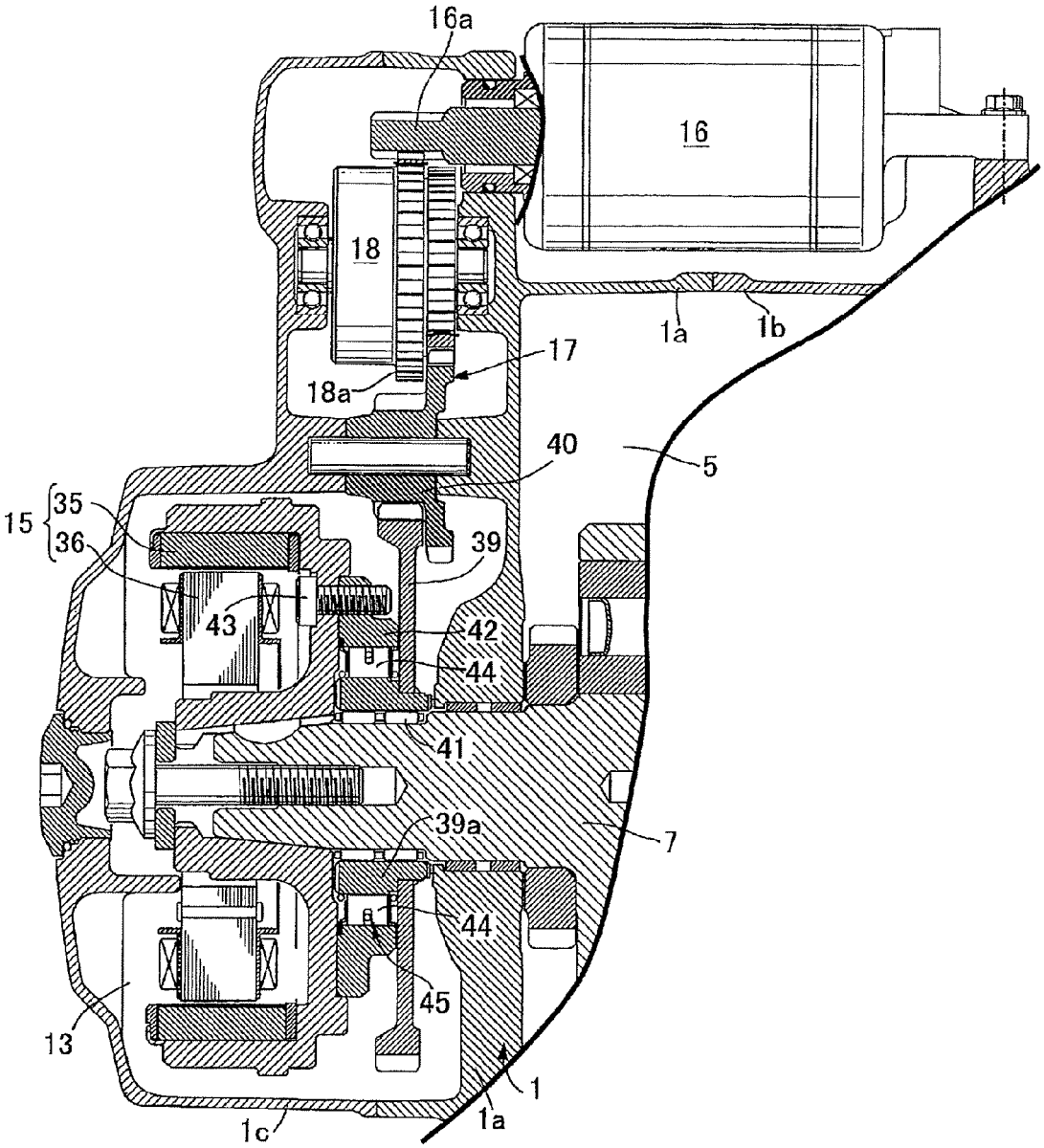
FIG. 3 is a cross-sectional view of the engine of FIG. 1, taken along the line 3-3 therein.

As shown in FIGS. 1 to 3, a generator case 13 is defined between the left case body 1*b* and the left case cover 1*c*, and a first power transmission chamber 14 is defined between the right case body 1*a* and the right case cover 1*d*, respectively. As shown in FIG. 1 and FIG. 3, a generator 15 which is driven by the crankshaft 7, and a starting gear mechanism 17 which connects an output shaft 16*a* of a starting motor 16 which is mounted on an upper outer wall of the crankcase 1 and the crankshaft 7 to each other, are housed in the generator case 13.

As shown in FIGS. 1 and 4, a wet-type multiple disc clutch 18, which is mounted on the input shaft 8, and a primary power transmission gear train 19 are housed in the first power transmission chamber 14. The primary power transmission gear train 19 operatively connects a clutch outer casing 18*a*, which is an input member of the clutch 18, to the crankshaft 7.

The transmission 10 is formed of a known multi-stage type transmission and includes transmission gear trains 20*a* to 20*e* in plural stages which are arranged on the input shaft 8 and the output shaft 9 in an extending manner and each of which is established by selection, a plurality of shift forks 72 which are operated for selectively establishing the transmission gear trains 20*a* to 20*e*, a shift drum 73 which drives the shift forks 72, and a change spindle 74 which rotatably operates the shift drum 73.

Returning to FIG. 1 and FIG. 2 again, a cylinder sleeve 2*a* is inserted in the cylinder block 2 by casting, and a piston 23 which is connected to the crankshaft 7 by way of a connecting rod 22 is fitted in the cylinder sleeve 2*a*. A timing chamber 21, which is arranged adjacent to a right side of the cylinder sleeve 2*a* and communicated with the first power transmission chamber 14, is formed in an extending manner between and over the crankcase 1 and the cylinder block 2. The timing chamber 21 houses a timing chain 33 and associated gears on the crankshaft 7 and the camshaft 32, respectively.

In the cylinder head 3, a combustion chamber 24 which is communicated with the inside of the cylinder sleeve 2*a*, an intake port 25 which is opened in the combustion chamber 24 from a rear side, and an exhaust port 26 which is opened in the combustion chamber 24 from a front side are formed. Due to such a constitution, an upstream end of the intake port 25 is opened on a back surface of the cylinder head 3, and a throttle body 80 having an intake air duct 81 which is communicated with the upstream end of the intake port 25 is mounted on the back surface of the cylinder head 3.

The throttle body 80 is provided with a throttle valve 82 which opens and closes the intake air duct 81 and a fuel injection valve 83 which injects fuel toward the intake port 25. On the other hand, a downstream end of the exhaust port 26 is opened on a front surface of the cylinder head 3, and an exhaust pipe (not shown in the drawing) which is communicated with the downstream end of the exhaust port 26 is mounted on the front surface of the cylinder head 3.

Further, a pair of ignition plugs 29*a*, 29*b* which make respective electrodes thereof face the combustion chamber 24 are threadably mounted in threaded receiving holes formed in the cylinder head 3.

A valve operating chamber 30 which is communicated with the timing chamber 21 is defined between the cylinder head 3 and the head cover 4, and a valve operating mechanism 31 which opens and closes intake and exhaust valves 27, 28 is housed in the valve operating chamber 30. The timing-chain 33, which connects the crankshaft 7 to a camshaft 32 of the valve operating mechanism 31, for power transmission therebetween, is housed in the timing chamber 21.

The generator 15 is formed of an outer-rotor-type generator and includes a cylindrical outer rotor 35 which is fitted on a left end portion of the crankshaft 7 by taper fitting and is fixed to the left end portion of the crankshaft 7 by a key 58 and a bolt 59, and a stator 36 which is bolted to an inner wall of the left case cover 1*c*, and which is arranged inside of the outer rotor 35.

As shown in FIG. 1 and FIG. 3, the starting gear mechanism 17 includes a torque limiter 37 which is driven by the output shaft 16*a* of the starting motor 16. An output gear 38 of the torque limiter 37 is meshed with a ring gear 39 which is rotatably supported on the crankshaft 7 by way of an intermediate gear 40. The ring gear 39 includes a hub 39*a* which is rotatably supported on the crankshaft 7 by way of a needle bearing 41. The hub 39*a* and an outer ring 42 which concentrically surrounds the hub 39*a* are fixed to the outer rotor 35 using a bolt 43. The hub 39*a*, the outer ring 42 and a large number of sprags 44 which are interposed between the hub 39*a* and the outer ring 42 constitute a one-way clutch 45 which assumes an engagement state only when the ring gear 39 is rotated in the normal direction (in a rotational direction A of the crankshaft 7, see FIG. 1).

Accordingly, when the ring gear 39 is rotated in the normal direction by operating the starting motor 16, a rotational torque of the ring gear 39 is transmitted to the outer rotor 35 and the crankshaft 7 by way of the one-way clutch 45 thus cranking the engine E whereby the engine E can be started. After starting the engine E, since the one-way clutch 45 is in a disengagement state, there is no transmission of rotation from the crankshaft 7 to the ring gear 39.

Figure 5:
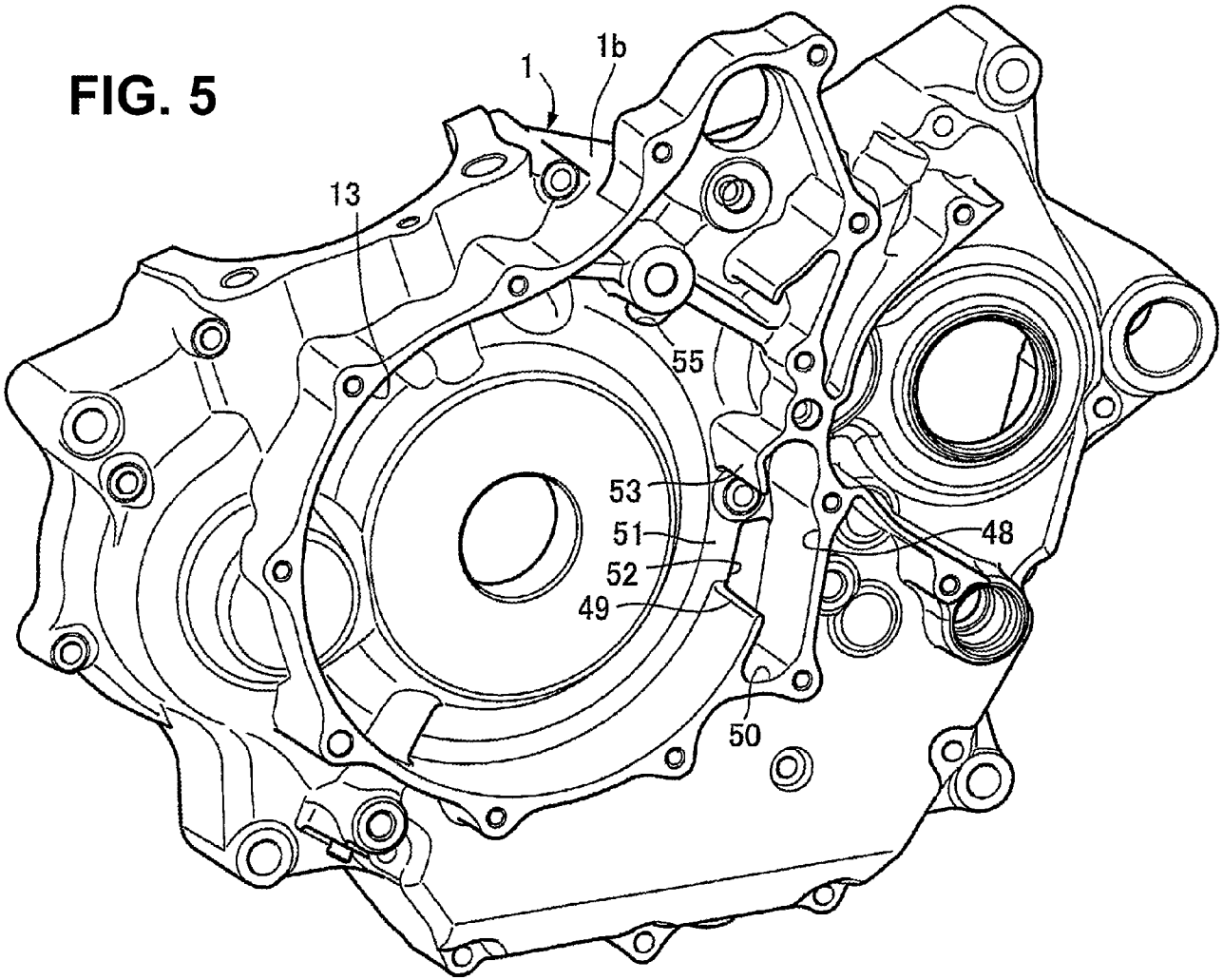
FIG. 5 is a perspective view of a left case body which is a part of a crankcase of the engine of FIGS. 1-4.
Figure 6:
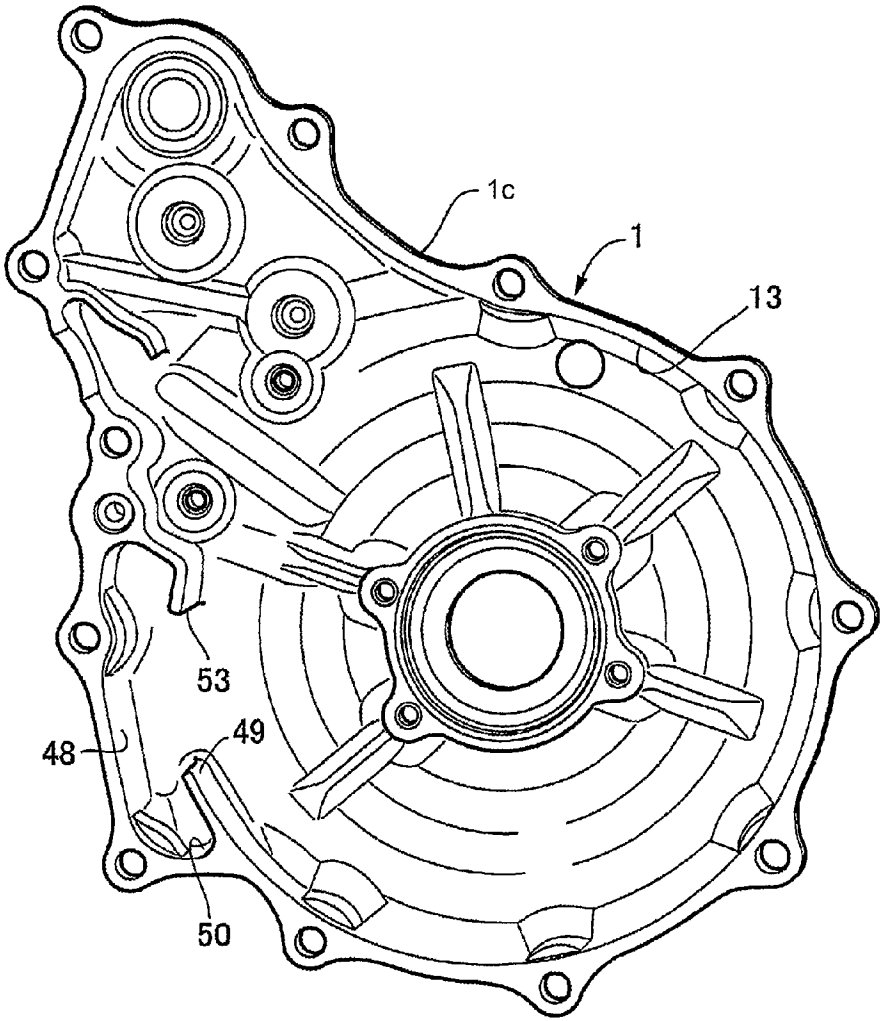
FIG. 6 is a perspective view of a left case cover which is a part of the crankcase of the engine of FIGS. 1-4.
Figure 7:
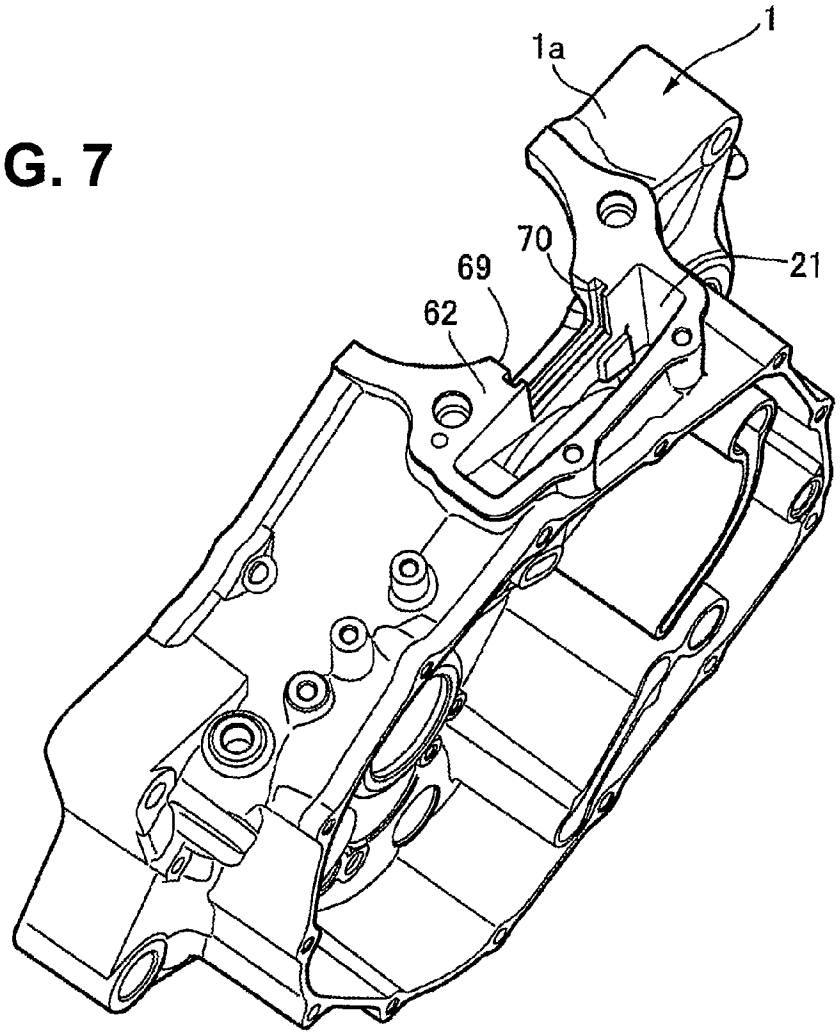
FIG. 7 is a perspective view of a right case body which is a part of the crankcase of the engine of FIGS. 1-4.

As shown in FIGS. 1, 5 and 6, at least a lower portion of an inner peripheral surface of the generator case 13 is formed in an arcuate shape so as to face an outer peripheral surface of the outer rotor 35 with a predetermined gap S1 therebetween. Further, on a rear portion of the inner peripheral surface of the generator case 13, a recessed portion 48 which extends in the vertical direction while arranging a position of an oil surface 12*a* in the oil reservoir 11 within a length of the recessed portion 48 and a flow-regulating plate 49 which is raised upright from a bottom surface of the recessed portion 48 on an inlet side of the recessed portion 48 are formed in a state where the recessed portion 48 and the flow-regulating plate 49 extend over the whole width of the generator case 13 in the lateral direction. Due to the presence of the flow-regulating plate 49, a weir groove 50 having a predetermined depth is defined in a lower portion of the recessed portion 48. The flow-regulating plate 49 is formed such that, in the same manner as the arcuate inner peripheral surface of the lower portion of the generator case 13, the flow-regulating plate 49 is formed in an arcuate shape so as to face the outer peripheral surface of the outer rotor 35 with the predetermined gap S1 therebetween, and also an upper end of the flow-regulating plate 49 is arranged at a position higher than a position of the oil surface 12*a* in the oil reservoir 11 by a predetermined distance.

On the other hand, in a partition wall 51 between the transmission chamber 6 and the generator case 13, an oil return hole 52 which allows the transmission chamber 6 and the recessed portion 48 to be communicated with each other is formed in a state where the oil return hole 52 faces the oil surface 12*a* in the oil reservoir 11 formed on the bottom portion of the transmission chamber 6. The oil return hole 52 is formed into an elongated-hole shape and extends from the weir groove 50 to a vertically intermediate portion of the recessed portion 48 passing the position of the oil surface 12*a*.

Further, on a rear portion of the inner peripheral surface of the generator case 13, an oil overturn portion 53 which extends downwardly from a ceiling surface of the recessed portion 48 on the inlet side of the recessed portion 48 is formed over the whole width of the generator case 13 in the lateral direction.

A gap S2 formed between the oil overturn portion 53 and the outer peripheral surface of the outer rotor 35 which face each other in an opposed manner, and this gap S2 is set smaller than the gap S1 formed between the flow-regulating plate 49 and the outer peripheral surface of the outer rotor 35 which face each other in an opposed manner. The recessed portion 48, the flow-regulating plate 49 and the oil overturn portion 53 are integrally formed with each other over the left case body 1*b* and the left case cover 1*c*.

Still further, above the oil overturn portion 53, in the generator case 13, a vent passage 55 which is communicated with a transmission chamber breather passage (not shown in the drawing) formed in an upper portion of the transmission chamber 6 is opened. The transmission chamber breather passage is communicated with a tube joint 57 which is mounted on an upper wall of the transmission chamber 6, and a breather tube 56 which is opened to the atmosphere is connected to the tube joint 57.

During the engine E is driven, oil stored in the oil reservoir 11 is sucked by an oil pump not shown in the drawing and the sucked oil is supplied to the respective parts of the engine E, and some oil is supplied to the generator case 13 from an oil nozzle 46 not shown in the drawing and serves for lubrication and cooling of the generator 15 and the one-way clutch 45. Oil stored on a bottom portion of the generator case 13 is scraped up toward a flow-regulating plate 49 side mainly by the outer peripheral surface of the outer rotor 35 of the generator 15 which is rotatably driven by the crankshaft 7, and oil which gets over the flow-regulating plate 49 falls in the weir groove 50 and, thereafter, the oil is returned to the oil reservoir 11 of the transmission chamber 6 through the oil return hole 52.

An unwanted backflow of oil toward an generator case 13 side from an oil return hole 52 side can be prevented by the flow-regulating plate 49. As a result, only an amount of oil necessary for lubrication and cooling of the generator 15 and the one-way clutch 45 remains in the generator case 13 at all times and hence, it is possible to keep a generation of friction between oil and the outer rotor 35 to a minimum, thus decreasing power loss attributed to such friction.

In addition, due to a presence of the weir groove 50 between the flow-regulating plate 49 and the oil return hole 52, even when the oil surface in the oil reservoir 11 ripples, the ripple of oil is attenuated by the weir groove 50 and hence, it is possible to prevent rippled oil from getting over the flow-regulating plate 49 toward the generator case 13 side.

Further, oil which is vigorously scraped up toward an area above the flow-regulating plate 49 by the outer peripheral surface of the outer rotor 35 is caught by the oil overturn portion 53 which is arranged above the flow-regulating plate 49, is guided to the ceiling surface of the recessed portion 48, falls down to the weir groove 50 after losing energy, and returns to the oil reservoir 11 through the oil return hole 52. Accordingly, it is possible to prevent oil which is vigorously scraped up toward the area above the flow-regulating plate 49 by the outer peripheral surface of the outer rotor 35 from returning to the generator case 13 thus effectively preventing undesired friction between oil and the outer rotor 35.

Further, the generator case 13 is communicated with the transmission chamber breather passage formed in the upper portion of the transmission chamber 6 by way of the vent passage 55 and hence, even when pressure fluctuation occurs due to a temperature change in the generator case 13, the generator case 13 breathes by making use of the transmission chamber breather passage corresponding to such pressure fluctuation, thus holding a pressure in the inside thereof at or close to an atmospheric pressure at all times. Accordingly, it is possible to substantially prevent leakage of oil from respective sealing portions. Further, an opening portion of the vent passage 55 which opens in the generator case 13 is arranged above the oil overturn portion 53 and hence, oil which is scraped up by the outer rotor 35 is caught by the oil overturn portion 53 as described above whereby it is possible to prevent an undesired movement of splashed oil from the generator case 13 to the vent passage 55 as much as possible.

Further, the flow-regulating plate 49 and the oil overturn portion 53 are integrally formed with the crankcase 1, that is, with the left case body 1*b* and the left case cover 1*c* and hence, it becomes unnecessary to increase the number of parts of the engine E, and this contributes to the reduction of cost.

Returning to FIG. 2 again, the cylinder sleeve 2*a* which is inserted in the cylinder block 2 by casting is formed such that a lower end portion of the cylinder sleeve 2*a* extends over a joint surface between the cylinder block 2 and the crankcase 1, and projects downwardly toward a crank chamber 5 side. An annular vent groove 61, which has a lower end thereof opened in the crank chamber 5, is formed between the lower end portion of the cylinder sleeve 2*a* and an inner peripheral surface of the crankcase 1, which faces towards an outer peripheral surface of the lower end portion of the cylinder sleeve 2*a* in an opposed manner.

A pressure-responsive one-way valve 63 is mounted on a side wall 62 of the crankcase 1 which is interposed between the vent groove 61 and the timing chamber 21. The one-way valve 63 allows a flow of a gas therethrough in one direction only, from a vent groove 61 side toward a timing chamber 21 side, where such flow corresponds to pressure pulsation in the crank chamber 5. The one-way valve 63, and a mounting structure associated therewith, are explained in conjunction with FIG. 2 and FIG. 8.

The one-way valve 63 is provided as a reed valve, which is one of the pressure-responsive valves. That is, the one-way valve 63 includes a base plate 64 which has a valve hole 65 formed therein, a thin reed valve plate 66 which is affixed to a side surface of the base plate 64 and arranged to cover the valve hole 65, and a stopper plate 67 which restricts a valve opening posture of the reed valve plate 66, while fixing one end of the reed valve plate 66 to the base plate 64 in a sandwiched manner. A rivet 68 or other fastener is used for fixing the stopper plate 67 to the base plate 64. A wall thickness of the one-way valve 63 is set smaller than a wall thickness of the side wall 62.

Figure 8:
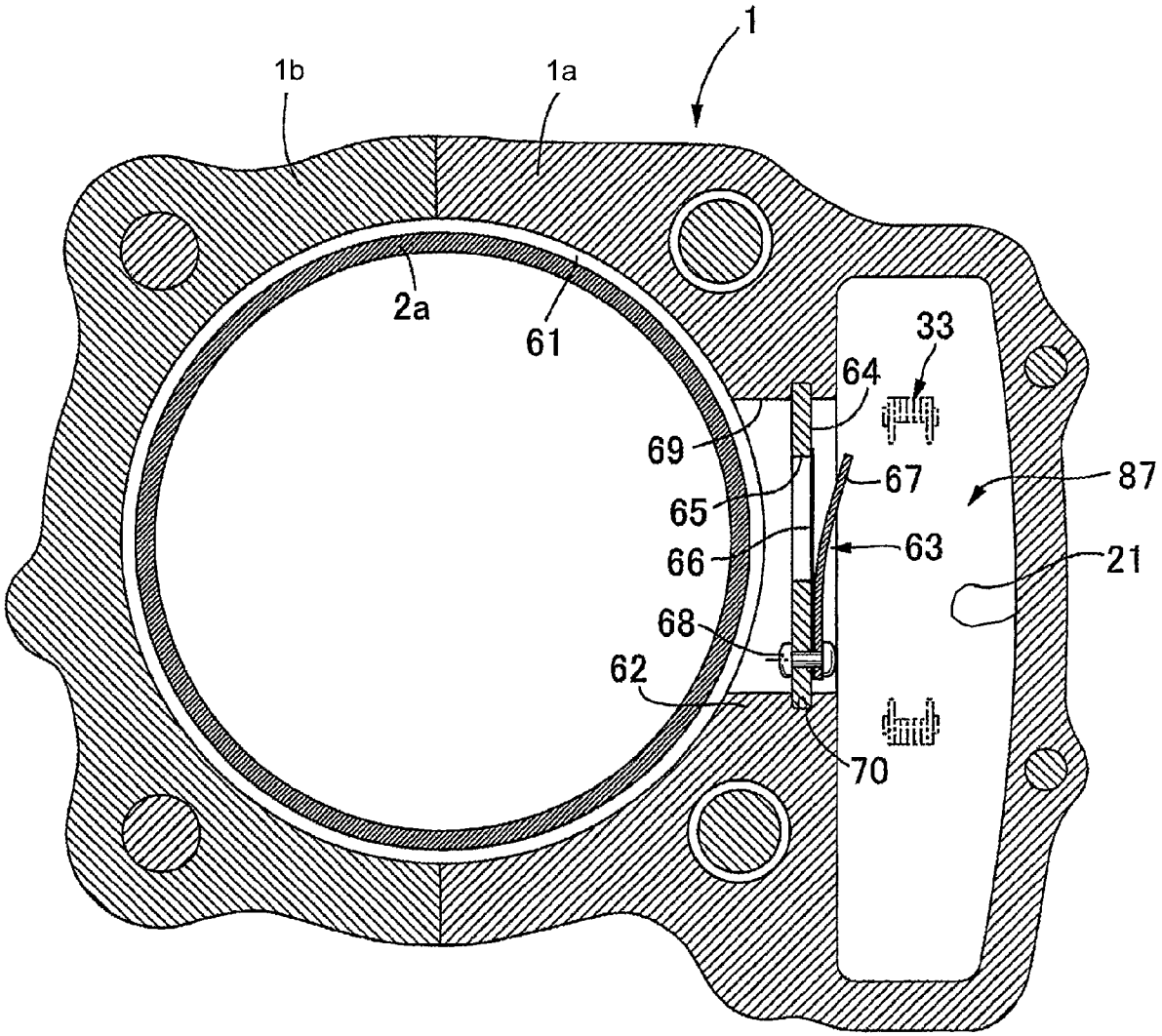
FIG. 8 is a cross-sectional view of the engine of FIGS. 1-4, taken along the line 8-8 in FIG. 2.

On the other hand, a lower surface of the cylinder block 2 is joined to an upper end surface of the side wall 62 arranged between the vent groove 61 and the timing chamber 21, that is, to an upper end surface of the crankcase 1. A mounting window 69 is formed in the side wall 62, in a U shape, by cutting away some of the material of the side wall 62 from an upper portion thereof. The mounting window 69 allows the vent groove 61 and the timing chamber 21 to be selectively communicated with each other through the one-way valve 63. As shown in FIG. 8, an engaging groove 70 is formed in an inner peripheral surface of the mounting window 69, and an outer peripheral edge portion of the one-way valve 63 is slidably fitted into the engaging groove 70.

In mounting the one-way valve 63, the outer peripheral edge portion of the one-way valve 63 is inserted into the engaging groove 70 of the mounting window 69 in a state where the base plate 64 is directed toward a vent groove 61 side. Here, an upper end surface of the one-way valve 63 is arranged to be substantially coplanar with the upper end surface of the crankcase 1. Accordingly, when the cylinder block 2 is joined to the crankcase 1, an upper opening surface of the mounting window 69 is closed by the lower end surface of the cylinder block 2, and the upper end surface of the one-way valve 63 is pushed downwardly by the lower end surface of the cylinder block 2, so that the mounting of the one-way valve 63 in the mounting window 69 is completed.

As shown in FIG. 2, a PCV (positive crankcase ventilation) valve 85, which is communicated with the valve operating chamber 30, is mounted on the head cover 4, and a breather tube 86 which is communicated with an air cleaner (not shown in the drawing) which is connected to an upstream side of the throttle body 80 is fluidly connected to the PCV valve 85. The breather tube 86, the valve operating chamber 30 and the timing chamber 21 cooperate to define a breather passage 87 which allows an outlet side of the one-way valve 63 to be communicated with an area outside of the crankcase.

During operation of the engine E, a pressure in the crank chamber 5 is pulsated repeatedly between a positive pressure and a negative pressure due to a vertical reciprocating movement of the piston 23. When the positive pressure is generated in the crank chamber 5, a gas in the inside of the crank chamber 5 containing a blowby-gas passes from the crank chamber 5 through the valve hole 65 of the one-way valve 63 by way of the vent groove 61, while opening the reed valve plate 66 by pushing. The gas flows out through the timing chamber 21, the valve operating chamber 30, and the breather pipe 86, in this order, to the air cleaner (not shown) which is part of an intake system, and is sucked into the combustion chamber 24 of the engine E together with an air-fuel mixture via the throttle body 80, and, thereafter, is subjected to combustion treatment.

On the other hand, when negative pressure is generated in the crank chamber 5, the reed valve plate 66 of the one-way valve 63 closes the valve hole 65 by a resilient valve-closing force thereof and a valve-closing force generated by the negative pressure which acts on the reed valve plate 66 through the valve hole 65. Therefore, it is possible to prevent a backflow of a gas from the timing chamber 21 side toward the vent groove 61 side, that is, toward the crank chamber 5 side, by the operation of the one-way valve 63. Accordingly, the timing chamber 21 and the valve operating chamber 30 each constitute a part of the breather passage 87, which opens the outlet side of the one-way valve 63 to an area outside of the crankcase.

The one-way valve 63 is formed as a pressure-responsive valve, and is mounted on the side wall 62 proximate the cylinder sleeve 2*a* of the crankcase 1. The pressure-responsive one-way valve 63, which is relatively small in size and has a simple structure, can be easily mounted by making use of the side wall 62 of the crankcase 1, which has a relatively large dead volume proximate the cylinder sleeve 2*a* and hence, the present invention can contribute to the simplification and the miniaturization of the structure of the breather apparatus leading to the miniaturization of the engine E and also the reduction of cost.

The timing chamber 21 is formed adjacent to the cylinder sleeve 2*a* in an extending manner between the crankcase 1 and the cylinder block 2, and to allow the timing chamber 21 to function also as a part of the breather passage 87, the one-way valve 63 is mounted on the side wall 62 of the crankcase 1 which is interposed between the timing chamber 21 and the crank chamber 5. Therefore, it is not necessary to form a dedicated breather passage inside of the engine body Ea, so that the present invention can contribute to the simplification of the structure of the breather apparatus.

Further, the vent groove 61, which is communicated with the crank chamber 5, is formed between the outer peripheral surface of the lower end portion of the cylinder sleeve 2*a* which projects toward the crankcase 1 side and the inner peripheral surface of the crankcase 1 which faces the outer peripheral surface in an opposed manner. The one-way valve 63 is mounted on the side wall 62 of the crankcase 1 which is interposed between the vent groove 61 and the timing chamber 21 and hence, it is difficult for splashing oil from the crank chamber 5 to intrude into the relatively narrow vent groove, so that it is possible to prevent the splashing oil from passing through the one-way valve 63 as much as possible.

Further, the pressure-responsive one-way valve 63 is provided as a reed valve which is formed by stacking the base plate 64 having the valve hole 65, the reed valve plate 66 which opens and closes the valve hole 65, and the stopper plate 67 on each other, the wall thickness of the one-way valve 63 is set smaller than the wall thickness of the side wall 62, and the whole valve is housed in the side wall 62. Accordingly, the one-way valve 63 can be easily mounted in the side wall 62 of the crankcase 1 having a relatively small wall thickness and hence, the present invention can largely contribute to the miniaturization of the engine E.

Still further, the mounting window 69 which allows mounting of the one-way valve 63 from the upper-end-surface side of the side wall 62 is formed in the side wall 62, and a mounting position of the one-way valve 63 on the mounting window 69 is held by the cylinder block 2 joined to the upper end surface of the side wall 62 and hence, a special holding means for holding the mounting position of the one-way valve 63 on the mounting window 69 is unnecessary, so that the present invention can contribute to the simplification of the mounting structure of the one-way valve.

Although the embodiment of the present invention has been explained heretofore, the present invention is not limited to the above-mentioned embodiment and various design changes are conceivable without departing from the gist of the present invention.

What is claimed is:

1. An engine body comprising:

a crankcase having a crank chamber formed therein and a breather passage outside of the crank chamber for permitting fluid communication between the crank chamber and an area outside of the engine body;

a breather apparatus comprising a one-way valve interposed between the crank chamber and the breather passage, wherein the one-way valve is configured to allow a one-way gas flow therethrough from the crank chamber to the breather passage, wherein the one-way valve is a pressure-responsive valve which is operatively attached to a side wall of the engine body proximate a cylinder sleeve thereof, wherein a timing chamber, which houses a timing power transmission device therein, extends between the crankcase and a cylinder block of the engine body adjacent to the cylinder sleeve, and wherein the side wall on which the one-way valve is mounted is a side wall of the crankcase interposed between the timing chamber and the crank chamber, and wherein the timing chamber functions as a part of the breather passage.

2. The engine body of claim 1, wherein:

a lower end portion of the cylinder sleeve projects downwardly from the cylinder block toward a crankcase side, a vent groove, which communicates with the crank chamber, is defined in the crankcase between an outer peripheral surface of the lower end portion of the cylinder sleeve and an inner peripheral surface of the crankcase which faces toward the cylinder sleeve, and the one-way valve controls fluid communication between the vent groove and the breather passage, and is operatively attached to the side wall of the crankcase between the vent groove and the breather passage.

3. The engine body of claim 1, wherein the one-way valve comprises a reed valve comprising a base plate having a valve hole formed therein, and a flexible reed valve plate which has one end thereof fixedly mounted on the base plate, wherein the reed valve plate is operable to close the valve hole, and has a wall thickness smaller than a wall thickness of the side wall, and wherein the one-way valve is housed in the side wall.

4. The engine body of claim 2, wherein the one-way valve comprises a reed valve comprising a base plate having a valve hole formed therein, and a flexible reed valve plate which has one end thereof fixedly mounted on the base plate, wherein the reed valve plate is operable to close the valve hole, and has a wall thickness smaller than a wall thickness of the side wall, and wherein the one-way valve is housed in the side wall.

5. The engine body of claim 3, wherein a mounting window is formed in the side wall, wherein the one-way valve is installed into the mounting window from an upper portion of the side wall, and wherein a mounting position of the one-way valve in the mounting window is held in place by the cylinder block joined to an upper end surface of the side wall.

6. The engine body of claim 4, wherein a mounting window is formed in the side wall, wherein the one-way valve is installed into the mounting window from an upper portion of the side wall, and wherein a mounting position of the one-way valve in the mounting window is held in place by the cylinder block joined to an upper end surface of the side wall.

7. An engine component comprising:

a first case body member for attaching to a second case body member to form a crankcase of the engine, the first case body member comprising a side wall having an interior side and an exterior side and having a breather passage formed therein to permit fluid communication between the interior and exterior sides; and a breather apparatus operatively attached to the first case body member and comprising a one-way valve interposed between the interior side and the breather passage, the one-way valve configured to allow a one-way gas flow therethrough from the interior side to the breather passage, wherein the one-way valve is a pressure-responsive valve which is operatively attached to the side wall of the first case body member for placement proximate a cylinder sleeve of the engine.

8. An engine body comprising the engine component of claim 7, wherein the breather passage forms a portion of a timing chamber for housing a timing power transmission device of the engine, the breather passage extending between a crankcase and a cylinder block of the engine body adjacent to the cylinder sleeve, and wherein the side wall on which the one-way valve is mounted comprises a side wall of a crankcase interposed between the timing chamber and a crank chamber on the interior side of the first case body member.

9. The engine body of claim 8, wherein:

a lower end portion of the cylinder sleeve projects from the cylinder block toward a crankcase side, a vent groove which communicates with the crank chamber is formed between an outer peripheral surface of the lower end portion of the cylinder sleeve and an inner peripheral surface of the crankcase which faces the outer peripheral surface in an opposed manner, and the one-way valve selectively controls communication between the vent groove and the breather passage, and is mounted on the side wall of the crankcase between the vent groove and the breather passage.

10. The engine component of claim 7, wherein the one-way valve comprises a reed valve comprising a base plate having a valve hole formed therein, and a flexible reed valve plate which has one end thereof fixedly mounted on the base plate, wherein the reed valve plate has elasticity in a closing direction of the valve hole, and has a wall thickness smaller than a wall thickness of the side wall, and wherein the one-way valve is housed in the side wall.

11. The engine component of claim 7, wherein the one-way valve comprises a reed valve comprising:

a base plate having a valve hole formed therein, a flexible reed valve plate which has one end thereof fixedly mounted on the base plate, and a stopper plate for limiting a valve opening posture of the reed valve plate, while fixing one end of the reed valve plate to the base plate in a sandwiched manner, wherein the reed valve plate has elasticity in a closing direction of the valve hole, and has a wall thickness smaller than a wall thickness of the side wall, and wherein the one-way valve is housed in the side wall.

12. The engine component of claim 10, wherein a mounting window which allows mounting of the one-way valve from an upper-end-surface side of the side wall is formed in the side wall, and a mounting position of the one-way valve on the mounting window is held by the cylinder block joined to an upper end surface of the side wall.

13. The engine component of claim 11, wherein a mounting window which allows mounting of the one-way valve from an upper-end-surface side of the side wall is formed in the side wall, and a mounting position of the one-way valve on the mounting window is held by the cylinder block joined to an upper end surface of the side wall.

14. An engine body comprising:

a crankcase comprising a first case cover and a second case cover which cooperate to support a crankshaft therebetween, the first case cover comprising a side wall having an interior side and an exterior side and having a breather passage formed therein to permit fluid communication between the interior and exterior sides;

a cylinder block which is fixedly attached to an upper surface of the crankcase, the cylinder block comprising an outer portion;

a cylinder sleeve which is integrally received in the outer portion of the cylinder block and which extends downwardly from the cylinder block into the crankcase with a vent groove formed therebetween; and a breather apparatus comprising a one-way valve interposed between the interior side and the breather passage of the first case cover, the one-way valve configured to allow a one-way gas flow therethrough from the interior side to the breather passage, wherein the one-way valve is a pressure-responsive valve which is operatively attached to the side wall of the first case body member and which is disposed proximate the cylinder sleeve of the engine.

15. The engine body of claim 14, wherein a timing chamber, which houses a timing power transmission device therein, extends between the crankcase and the cylinder block of the engine body adjacent to the cylinder sleeve, and wherein the side wall of the first case cover on which the one-way valve is mounted is interposed between the timing chamber and the crank chamber, wherein the timing chamber functions as a part of the breather passage.

16. The engine body of claim 15, wherein:

the vent groove, which communicates with the crank chamber, is defined between an outer peripheral surface of a lower end portion of the cylinder sleeve and an inner peripheral surface of the crankcase which faces toward said outer peripheral surface of the cylinder sleeve, and the one-way valve selectively controls communication between the vent groove and the breather passage, and is operatively attached to the side wall of the crankcase between the vent groove and the breather passage.

17. The engine body of claim 15, wherein the one-way valve comprises a reed valve comprising a base plate having a valve hole formed therein, and a flexible reed valve plate which has one end thereof fixedly mounted on the base plate, wherein the reed valve plate is operable to close the valve hole, and has a wall thickness smaller than a wall thickness of the side wall, and wherein the one-way valve is housed in the side wall.

18. The engine body of claim 14, wherein a mounting window is formed in the side wall, wherein the one-way valve is installed into the mounting window from an upper portion of the side wall, and wherein a mounting position of the one-way valve in the mounting window is held in place by the cylinder block joined to an upper end surface of the side wall.

19. The engine body of claim 15, wherein a mounting window is formed in the side wall, wherein the one-way valve is installed into the mounting window from an upper portion of the side wall, and wherein a mounting position of the one-way valve in the mounting window is held in place by the cylinder block joined to an upper end surface of the side wall.

* * * * *